US010850292B2

(12) United States Patent
Lecoutre

(10) Patent No.: US 10,850,292 B2
(45) Date of Patent: Dec. 1, 2020

(54) REFILLABLE FLUID PRODUCT DISPENSER

(71) Applicant: APTAR FRANCE SAS, Le Neubourg (FR)

(72) Inventor: Jean-Paul Lecoutre, Conde sur Iton (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 16/604,294

(22) PCT Filed: Apr. 9, 2018

(86) PCT No.: PCT/FR2018/050877

§ 371 (c)(1),
(2) Date: Oct. 10, 2019

(87) PCT Pub. No.: WO2018/189466

PCT Pub. Date: Oct. 18, 2018

(65) Prior Publication Data

US 2020/0038893 A1 Feb. 6, 2020

(30) Foreign Application Priority Data

Apr. 11, 2017 (FR) ..... 17 53169

(51) Int. Cl.
*B05B 11/00* (2006.01)

(52) U.S. Cl.
CPC .... *B05B 11/0056* (2013.01); *B05B 11/00418* (2018.08); *B05B 11/3023* (2013.01)

(58) Field of Classification Search
CPC ..... B05B 11/0056; B05B 11/00418; B05B 11/3023; B05B 11/30
See application file for complete search history.

(56) References Cited

U.S. PATENT DOCUMENTS 4,750,532 A 6/1988 Grothoff
6,302,304 B1 * 10/2001 Spencer ..... B05B 11/3001 222/260
7,665,635 B2 * 2/2010 Ramet ..... B05B 11/0056 222/321.7
7,743,949 B2 * 6/2010 Ramet ..... B05B 11/00418 222/321.9

(Continued)

FOREIGN PATENT DOCUMENTS

EP 1 579 924 A1 9/2005
EP 2 977 110 A1 1/2016

(Continued)

OTHER PUBLICATIONS

International Search Report for PCT/FR2018/050877 dated Sep. 10, 2018 [PCT/ISA/210].

(Continued)

*Primary Examiner* — Donnell A Long
(74) *Attorney, Agent, or Firm* — Sughrue Mion, PLLC

(57) ABSTRACT

A refillable fluid dispenser having a dispenser head including a fluid pump, such as a pump or a valve; a reservoir of variable volume; and a filling valve that is connected to the reservoir. The dispenser further comprises an air pump of variable volume, having a volume that varies inversely with the volume of the reservoir, so as to create resistance to the variation in volume of the reservoir.

9 Claims, 2 Drawing Sheets

(56) References Cited

U.S. PATENT DOCUMENTS

| | | | | |
|---|---|---|---|---|
| 8,448,677 | B2 * | 5/2013 | Ficai | B65D 1/06 141/113 |
| 8,695,896 | B2 * | 4/2014 | Tu | B05B 11/0035 239/333 |
| 8,978,938 | B2 * | 3/2015 | Hui | B05B 11/0056 222/402.16 |
| 9,146,144 | B2 * | 9/2015 | Hui | B65B 3/10 |
| 9,204,994 | B2 * | 12/2015 | Greiner-Perth | B05B 11/0067 |
| 9,365,408 | B2 * | 6/2016 | Tu | B05B 11/0056 |
| 9,522,403 | B2 * | 12/2016 | Hui | B05B 11/0008 |
| 9,676,528 | B2 * | 6/2017 | Hui | A45D 34/00 |
| 10,279,362 | B2 * | 5/2019 | Tu | A45D 34/00 |

FOREIGN PATENT DOCUMENTS

| | | | |
|---|---|---|---|
| FR | 2 971 774 | A1 | 8/2012 |
| WO | 2013/014626 | A2 | 1/2013 |

OTHER PUBLICATIONS

International Preliminary Report on Patentability and Translation of Written Opinion from the International Bureau in application No. PCT/FR2018/050877 dated Oct. 24, 2019.

* cited by examiner

REFILLABLE FLUID PRODUCT DISPENSER

CROSS REFERENCE TO RELATED APPLICATIONS

This application is a National Stage of International Application No. PCT/FR2018/050877, filed on Apr. 9, 2018, which claims priority from French Patent Application No. 1753169, filed on Apr. 11, 2017.

The present invention relates to a refillable fluid dispenser comprising: a dispenser head including a fluid pump; a reservoir of variable volume; and a filling valve that is connected to the reservoir. Advantageous fields of application of the present invention are the fields of perfumery, cosmetics, and pharmacy. This type of refillable dispenser is often designated under the term "travel" dispenser. In general, it presents a reservoir of small capacity of about 10 milliliters (mL) at most.

In the prior art, document FR 3 024 056 is known, which describes a refillable dispenser in which the filling valve is secured to the dip tube that is connected to the pump so as to perform filling. The user is obliged to pull on the filling valve so as to bring the dispenser into a state in which it can be filled. The structure of that dispenser is very complex and its use is not really intuitive.

An object of the present invention is to define a refillable dispenser having a hand action for refilling that is simpler, more intuitive, or more obvious to an uninformed user. Another object of the present invention is to be able to refill the refillable dispenser by means of a standard source bottle fitted with a conventional valve rod. Still another object of the present invention is to have a reservoir structure of variable volume that generates or imposes manipulation with a different hand action. Another object is to guarantee opening the source bottle without exerting constant pressure on the fluid stored in the reservoir. More particularly, the source bottle should open when the filling valve is pressed against the source bottle.

To do this, the present invention proposes a refillable fluid dispenser comprising: a dispenser head including a fluid pump; a reservoir of variable volume; and a filling valve that is connected to the reservoir;

the fluid pump being provided with a dip tube that passes through the reservoir, a slidable member including a movable piston that slides in sealing contact around the dip tube so as to cause the volume of the reservoir to vary, the slidable member being movable between a pushed-in position in which the slidable member is situated in the proximity of the pump, and an extended position in which the slidable member is spaced apart from the fluid pump, the reservoir defining a maximum volume in its pushed-in position, and a minimum volume in its extended position, such that the volume of the reservoir increases when the slidable member is pushed in around the dip tube towards the fluid pump, the dip tube being provided with a stationary piston that slides in sealing contact in a movable cylinder that is formed by the slidable member, the movable piston sliding around the dip tube between the fluid pump and the stationary piston, the reservoir being defined axially between the movable piston and the stationary piston, and radially between the dip tube and the movable cylinder;

the dispenser further comprising an air pump of variable volume, having a volume that varies inversely with the volume of the reservoir, so as to create resistance to the variation in volume of the reservoir. It is precisely this resistance to the variation in volume that is used to exert sufficient force on the valve rod of the source bottle and thus open its outlet valve. Instead of the expression "air pump", it is also possible to use the expressions "air chamber" or "pneumatic cylinder", or pneumatic brake". In very general manner, the air pump has the function of causing the pressure of the air to increase or to decrease momentarily.

Advantageously, the air pump is not sealed, thereby communicating with the outside, such that the air in the air pump is put under pressure momentarily during a variation in volume, and then returns to atmospheric pressure a short time after the end of the variation in volume. In an embodiment, the air pump may include a vent hole via which air enters and leaves the air pump, thereby enabling the air to return to atmospheric pressure after each variation in volume. The air leak of the air pump is preferably calibrated so that a sudden and massive variation, as during filling, generates a momentary increase in pressure in the air pump, and so that a slow and/or small variation, as during fluid dispensing, generates a momentary decrease in pressure in the air pump that is only very small. Thus, when the user presses the filling valve hard against the valve rod of the source bottle, the volume of the air pump varies suddenly and massively, putting the air that it contains under pressure so as to create pneumatic resistance that is sufficient to move the valve rod of the source bottle and open its outlet valve. The pressure in the air pump persists for as long as the user causes its volume and the volume of the reservoir to vary, but without increasing exponentially, given that air under pressure escapes from the air pump through its leak. When the reservoir is full, the volume of the air pump has reached its minimum, but the air under pressure that it contains continues to escape until it returns to atmospheric pressure. In contrast, during fluid dispensing stages, the volume of the air pump does indeed vary, but very little, which enables it to remain at atmospheric pressure almost continuously. To summarize, the air pump acts as a dynamic brake on the variation in volume of the reservoir, which dynamic brake is genuinely active only during filling stages, and is almost completely inactive outside filling stages. Furthermore, using such an air pump is very simple and avoids the use of a spring.

Furthermore, the reservoir is filled by pressing the dispenser against the source bottle, and not by pulling on the dispenser. This hand action is entirely conventional and intuitive, calling on the user to press against the source bottle in order to fill or refill the reservoir. As a result of the air pump, it is guaranteed that the outlet valve of the source bottle opens.

Thus, the reservoir is empty, or practically empty, when the two pistons are as close together as possible, and full, or practically full, when they are as far apart as possible. It can also be said that the reservoir is full, or practically full, when the movable piston is as close as possible to the pump. It can also be said that the reservoir is empty when the slidable member is extended as much as possible. Conversely, it can be said that the air pump is at its maximum volume when the slidable member is extended as much as possible, and at its minimum volume when the movable piston is as close as possible to the pump. It thus suffices for the user to position the filling valve on the valve rod of a source bottle and to press thereon until the slidable member comes into abutment, in its pushed-in position, close to the pump. There is no need to worry about pushing in the valve rod of the source bottle, since this is guaranteed by putting the air pump under pressure, which happens simultaneously with the volume of the reservoir increasing. Thus, the outlet valve is opened when the filling valve is pressed hard enough against the valve rod of a source bottle.

Advantageously, the air pump is defined axially between the stationary piston and the filling valve, and is arranged axially below the reservoir. The stationary piston is thus common to the fluid reservoir and to the air pump.

In a practical embodiment, a stationary sleeve is engaged around the dip tube, the stationary sleeve defining a free bottom end that forms a sealing lip that is engaged to slide in sealed manner in a movable tube that is secured to the slidable member, the air pump being defined radially between firstly the stationary sleeve and the movable tube and secondly the movable cylinder. Preferably, the movable cylinder includes a vent hole.

According to an advantageous characteristic, the dip tube is permanently secured to the pump, and the filling valve is permanently secured to the slidable member.

According to another advantageous characteristic, the filling valve communicates with the reservoir through an intermediate chamber of volume that varies inversely with the volume of the reservoir. In other words, the dispensing reservoir fills while the intermediate chamber empties. Preferably, the volume of the dispensing reservoir is greater than the volume of the intermediate chamber. In addition, the intermediate chamber may communicate with the reservoir through at least one stationary channel that is secured to the dip tube. In a practical embodiment, a stationary sleeve is engaged around the dip tube so as to define between them said at least one stationary channel, the stationary sleeve defining a free bottom end that forms a sealing lip that is engaged to slide in sealed manner in a movable tube that is secured to the slidable member, thereby defining the intermediate chamber, the stationary piston advantageously being formed by the stationary sleeve.

In another advantageous aspect of the invention, the movable piston is formed at one end of the movable cylinder, and the filling valve is mounted at the other end of the movable cylinder.

In a practical embodiment, the filling valve comprises a valve support that is engaged in the movable cylinder and that forms a movable tube in which a sealing lip is engaged, thereby co-operating with each other to define an intermediate reservoir through which the filling valve communicates with the reservoir.

According to an advantageous characteristic of the invention, the dispenser further comprises a case that is secured to the dip tube and in which the slidable member is movable by sliding in sealed manner around the dip tube.

The spirit of the present invention resides in making use of the variation in volume of an air pump coupled to the fluid reservoir in order to create momentary dynamic resistance that makes it possible to press on the valve rod of a source bottle sufficiently to cause its outlet valve to open. The leak of the air pump makes it possible to decrease its volume (while the volume of the fluid reservoir increases) while limiting the increase in pressure in the air pump. Once the reservoir is full, the air pump reaches its minimum volume, and after a short time (lying in the range about 2 seconds (s) to about 5 s), the air in the air pump is once again at atmospheric pressure, such that the fluid reservoir is not subjected to any pressure from the air pump.

The advantages of the air pump are as follows:

- pressure in the air pump increases only during filling stages;
- the fluid reservoir is not under pressure at rest;
- there is no risk of fluid leaking out from the reservoir, given that it is not under pressure;
- the dispensing of fluid through the pump is not influenced in any way, given that the reservoir is not under pressure;
- the air pump is very easy to make without any additional part, by using the stationary piston that is shared with the fluid reservoir;
- the leak in the form of a calibrated vent hole is very simple to make in the movable cylinder.

The invention is described below more fully with reference to the accompanying drawings, which show an embodiment of the invention by way of non-limiting example.

Figure 1:
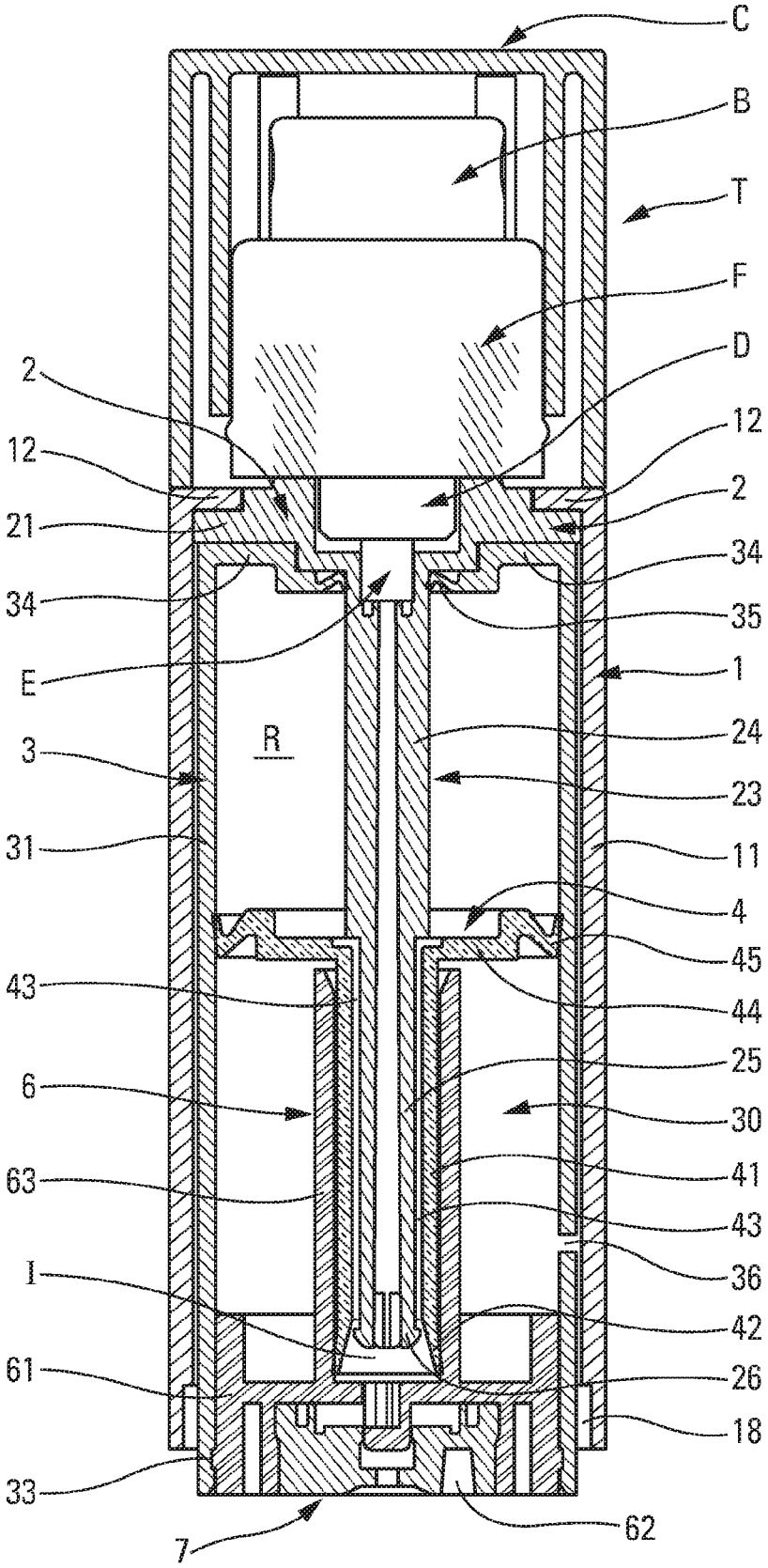
FIG. 1 is a vertical section view through a refillable dispenser of the invention with its reservoir full.

Reference is made firstly to FIG. 1 in order to describe in detail the structure of a dispenser made in accordance with the invention. The refillable dispenser comprises a dispenser head T and a container that are associated with each other in order to form the dispenser. The dispenser head T may be an entirely conventional dispenser head with a fluid pump D comprising a body that defines a fluid inlet in the form of an axial inlet tube E. The fluid pump D further comprises an actuator rod (not shown) on which there is mounted a pushbutton B. By pressing on the pushbutton B, fluid is put under pressure in a pump defined inside the body. The pushbutton B may define a dispenser orifice via which the fluid delivered by the pump is dispensed in the form of spray, a jet, or drops. In order to fasten the pump on the container, a fastener member F is provided that holds the body in stationary manner and that fastens on a neck or an opening of the container. A removable cap C may optionally cover the fluid pump D and the pushbutton B. This is an entirely conventional design for a dispenser head in the fields of perfumery, cosmetics, and pharmacy. Given that the dispenser head is not critical for the present invention, it is not described in greater detail below.

The container on which the dispenser head T is mounted presents a particular shape that should not be considered as limiting in its structure. The term "container" should be considered as the complete lower sub-assembly that co-operates with the upper sub-assembly formed by the dispenser head T. The container incorporates a fluid reservoir R and other functional members, as described below. In this particular non-limiting embodiment, the container forms a dip tube 23 to which the inlet E of the fluid pump D of the dispenser head T is connected. Without going beyond the ambit of the invention, it is entirely possible to incorporate the dip tube 23 in the dispenser head T and not in the container.

The container comprises a plurality of component parts, namely a case 1, an insert 2, a slidable member 3, a stationary sleeve 4, a valve support 6, and a filling valve 7. None of the parts should be considered as essential and unchangeable in its structure.

The case 1 comprises an outer casing 11 that may present any geometrical shape, e.g. circularly cylindrical, as in the figures. At its top end, the case 1 further comprises an inwardly-directed shoulder 12, and at its bottom end, an inner fastener profile 18. The outer casing 11 can normally be seen from the outside and is for gripping by the user so as to be able to press on the pushbutton B by means of an index finger.

The insert 2 includes an annular disk 21 that projects radially outwards. It can be seen that the disk 21 is arranged just below the inwardly-directed shoulder 12 of the case 11, in FIG. 1. A neck 22 extends upwards from the disk 21: preferably it presents a fastener profile that is suitable for co-operating with the fastener ring F of the dispenser head T. The insert 2 also forms the dip tube 23 that extends downwards. The dip tube 23 comprises a top section 24, and a bottom section 25 of smaller diameter. The outer wall of the top section 24 is preferably circularly cylindrical. At its free bottom end, the bottom section 25 forms a plurality of snap-fastener teeth 26 having a function that is explained below. The outer wall of the bottom section 25 may be completely circularly cylindrical, or it may be formed with vertical splines that co-operate with one another to define grooves between them. At the junction between the top section 24 and the bottom section 25, a downwardly-directed shoulder is formed.

Without going beyond the ambit of the invention, it is entirely possible to make the neck 22 and the disk 21 integrally with the case 11, and to connect the dip tube 23 directly to the inlet E of the fluid pump D. In another variant, it is also possible to pass a dip tube connected to the inlet E through the insert 2 provided with a tube, that is no longer a dip tube, but that is capable of receiving therein the dip tube of the fluid pump D.

The slidable member 3 is a part that is movable relative to the case 1 and to the insert 2. The slidable member 3 comprises a movable cylinder 31 of shape that is cylindrical, preferably circularly cylindrical. At its top end, the slidable member 3 further comprises a radial flange 34 that is terminated internally by a movable piston 35 that comes into sliding sealing contact with the outer wall of the dip tube 23, over its top section 24. At its bottom end, the inside of the movable cylinder 31 forms a fastener profile having a function that is explained below. The slidable member 31 is preferably made as a single part with one or more different plastics materials. By way of example, it is possible to envisage that the movable piston 35 is made out of a material that is more flexible than the movable cylinder 31.

The stationary sleeve 4 is engaged in stationary manner around the bottom section 25 of the dip tube 23. More precisely, the stationary sleeve 4 includes a sheath 41 that is force-fitted around the bottom section 25. The inner wall of the sheath 41 may be completely cylindrical, or it may be formed with radial ribs that co-operate with one another to define grooves between them. In any event, one or more channels 43 are formed between the sheath 41 and the bottom section 25: the channels 43 extend over the entire height of the sheath 41 in such a manner as to open out on either side. The stationary sleeve 4 also forms a collar 44 that extends radially outwards so as to form, on its outer periphery, a stationary piston 45 that is in sliding sealing contact with the movable cylinder 31 of the slidable member 3. In order to guarantee that the sleeve 4 is fastened around the bottom portion 25 of the dip tube 23, the snap-fastener heads 26 can come into engagement below the ribs formed inside the sheath 41. It should also be observed that the free end of the sheath 41 forms a sealing lip 42 having a function that is explained below.

A reservoir R is thus formed inside the container. More precisely, the reservoir R is defined axially between the flange 34 (with its movable piston 35) and the collar 44 (with its stationary piston 45), and radially between the movable cylinder 31 and the outer wall of the top section 24 of the dip tube 23. It can easily be understood that the volume of the reservoir varies, given that the slidable member 3 can move inside the case 1, with its movable piston 35 in sliding sealing contact around the dip tube 23. Simultaneously, the movable cylinder 31 moves relative to the stationary piston 45 of the sleeve 4.

The valve support 6 includes a fastener bushing 61 that is force-fitted in sealed manner inside the movable cylinder 31 of the slidable member 3. The bushing 61 co-operates with the fastener profile 33 so as to guarantee that it is held in place. The valve support 6 also forms a reception housing 62 for the filling valve 7 that may be of entirely conventional design. The filling valve may be a valve that is opened mechanically or hydraulically. The valve support 6 also forms a movable tube 63 that is engaged around the sheath 41 that forms the sealing lip 42 at its bottom end. Thus, an intermediate chamber I is formed inside the movable tube 63 above below the inlet of the dip tube 23.

In the invention, an air pump 30 is also formed inside the container. More precisely, the air pump 30 is defined axially by the stationary piston 45 (that also defines the reservoir R) and by the valve support 6, and it is defined radially by the slide cylinder 31 and by the sheath 41 and the movable tube 63. The air pump 30 is thus arranged axially below the reservoir R and together they share the stationary piston 45. The volume of the air pump 30 increases when the volume of the reservoir R decreases, and vice-versa. It can be said that the two volumes vary inversely. The air in the air pump 30 is thus subjected to pressure variations, thereby creating a pneumatic brake that opposes the variations in volume of the reservoir R. Advantageously, the pressure variations in the air pump 30 are attenuated or limited by an air leak in the air pump 30, which leak may be in the form of a calibrated vent hole 36 that is formed in the slide cylinder 31, for example. Once the volume of the air pump 30 has stopped varying, the leak also enables it to return to atmospheric pressure in a time that is very short, lying in the range about 1 s to about 5 s. This relaxation time depends on the size of the vent hole 36, which should thus be calibrated accurately.

With reference once again to FIG. 1, it should now be observed that the reservoir R is full and thus presents a maximum volume. The flange 34 is in abutment against the disk 21. Conversely, the air pump 30 and the intermediate chamber I present a minimum volume, given that the sealing lip 42 comes almost into abutment against the bottom of the movable tube 63. However, the reservoir R communicates with the intermediate chamber I through the channels 43. In addition, the dip tube 23 communicates directly with the intermediate chamber I, such that the inlet E of the fluid pump D is in fluid communication with the reservoir R. Thus, actuating the pushbutton B causes the fluid in the reservoir R to be dispensed. The fluid in the reservoir R travels through the channels 43, the intermediate chamber I, and the dip tube 23 up to the inlet E of the fluid pump D. The fluid may be dispensed through a dispenser orifice that is formed in the pushbutton B.

Figure 3:
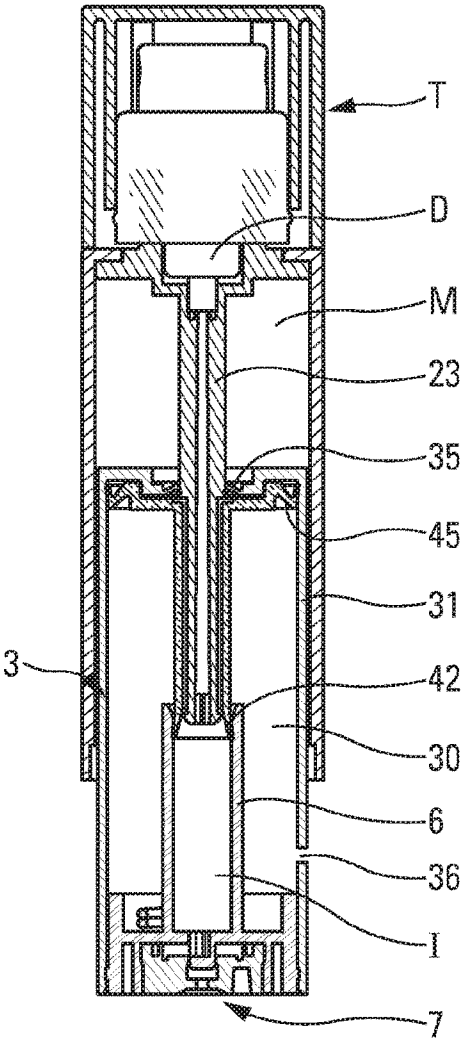
FIG. 3 is a view similar to the view in FIG. 1 with the reservoir in its empty state.
Figure 2:
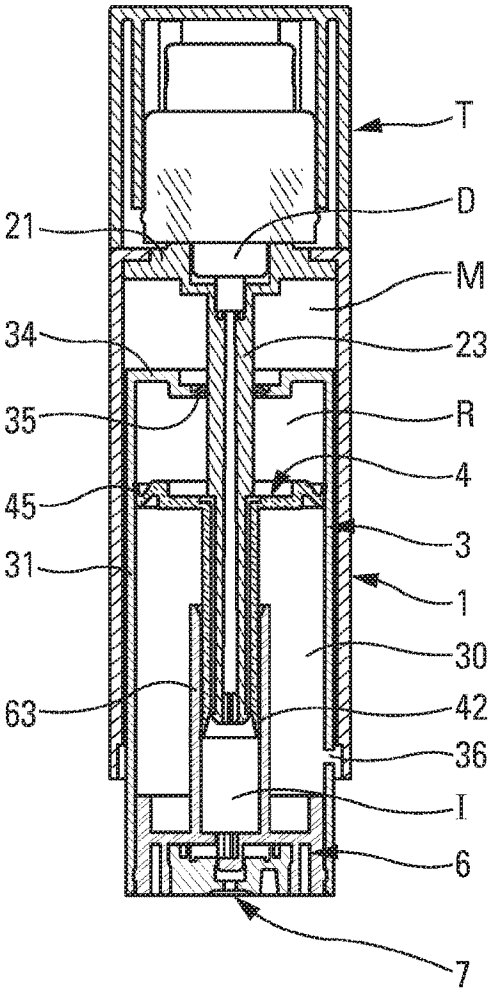
FIG. 2 is a view similar to the view in FIG. 1 with the reservoir half empty.

As the fluid in the reservoir R is dispensed, the movable member 3 moves downwards away from the fluid pump D. A dead space M is thus created between the disk 21 and the flange 34, which dead space M communicates with the outside between the case 1 and the movable cylinder 31. This state of the dispenser is shown in FIG. 2 in which it can be seen that the reservoir R is half full or half empty. It should be observed that the air pump 30 has increased in volume, given that a portion of the sheath 41 is now disengaged from the tube 63. The variation in volume is very limited, such that reduction in pressure in the air pump 30 is small and disappears very quickly with the addition of a small amount of outside air that penetrates into the air pump 30 through the vent hole 36. It should also be observed that the intermediate chamber I has increased in volume, given that the valve support 6, which is secured to the slide member 3, has moved downwards, while the stationary sleeve 4 has remained in place on the dip tube. It can thus be said that the volume of the reservoir R decreases as the volumes of the air pump 30, the intermediate chamber I, and the dead space M increase. However, it should be observed that the section of the intermediate chamber I is much smaller than the section of the reservoir R, such that the volume of the intermediate chamber I increases more slowly than the volume of the reservoir decreases, and vice versa. Given that the slidable member 3 moves downwards, its bottom end projects progressively beyond the case 1, thereby allowing the indicator mark 32 to appear. FIG. 3 is shown without the cover 8, but said cover may very well remain in place since its height makes it possible to move the slidable member 3 and the indicator marking 32 is visible through the display window 82.

Dispensing continues until the reservoir R is completely empty. This is the situation in the configuration shown in FIG. 3. The volume of the reservoir R is practically zero, while the volumes of the intermediate chamber I and the dead space M are at their maximum. The slidable member 3 is thus in its extended position in which the movable piston 35 is at its furthest away from the fluid pump D. It should even be observed that the movable piston 35 is practically at the same axial height as the stationary piston 45. The sealing lip 42 is positioned at the top end of the movable tube 63.

Figure 4:
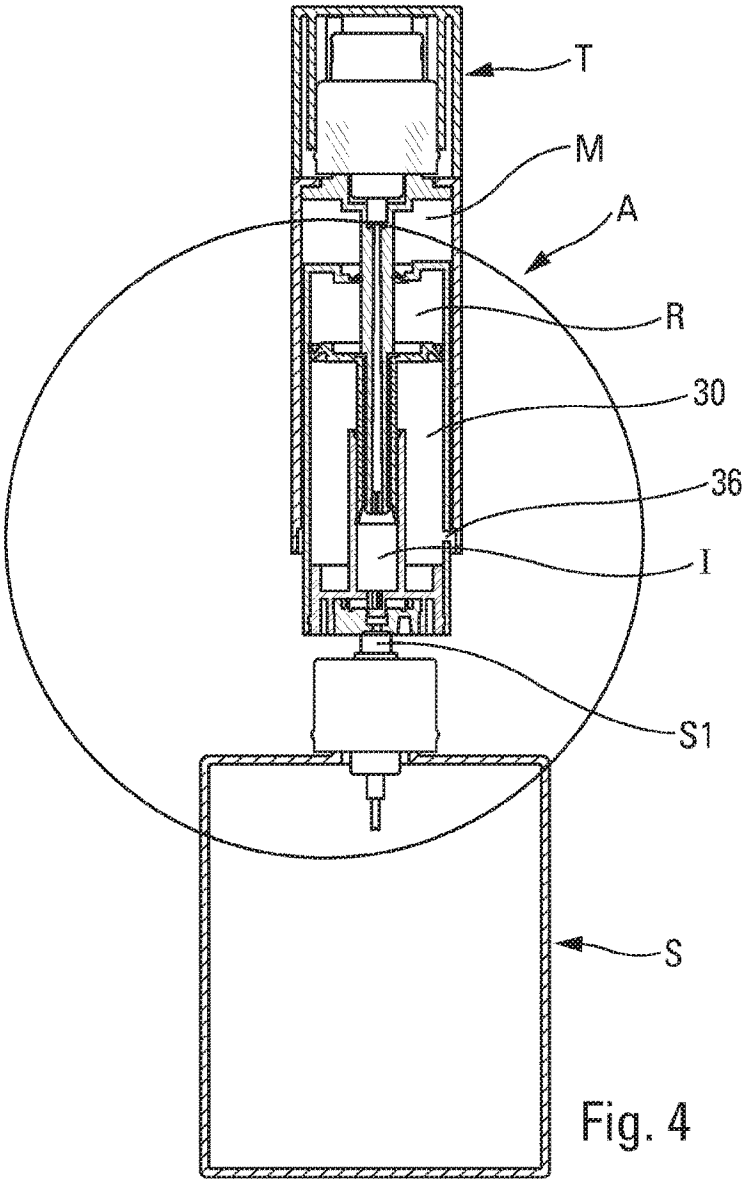
FIG. 4 is a view similar to FIG. 1 with the dispenser connected to a source bottle that has already half filled the reservoir.

In order to refill the reservoir R, the user can arrange the filling valve 7 on a source bottle S, as shown in FIG. 5. In entirely conventional manner, the source bottle S includes a pump or a valve that is provided with a valve rod S1 that is movable downwards and upwards against an internal spring so as to open an outlet valve. Thus, it is necessary to press on the valve rod S1 with axial force that is sufficient to press on and thus open the outlet valve. The user should thus press the refillable dispenser on the valve rod S1 with sufficient axial force, so that fluid from the source bottle S rises into the intermediate chamber I, then through the channels 43, and into the reservoir R, with its volume then increasing. In FIG. 4, the dispenser is shown with the reservoir R half full.

In the absence of an air pump 30, pressing on the valve rod S1 would open the outlet valve only once the slidable member 3 had travelled along a large fraction of its stroke towards the fluid pump D. Specifically, almost nothing would retain the slidable member 3, other than the increasingly reduced pressure in the reservoir R, so the slidable member 3 would move without moving the valve rod S1. The valve rod S1 would be moved only at the end of the stroke once the pressure decrease in the reservoir reaches a value that is greater than the force needed to move the valve rod S1.

With the air pump 30 of the invention, the pressure in the air pump 30 increases suddenly and massively when the user presses the refillable dispenser hard against the valve rod S1. The increased pressure created in this way acts as a momentary dynamic brake that opposes the variation in the volume of the reservoir R, and that increases the reduction in pressure in the reservoir R, thereby together exerting a force that is sufficient to move the valve rod S1. Thus, the increased pressure participates in the thrust force on the valve rod S1 so that it moves almost immediately. By means of the leak of the air pump 30, the increase in pressure is limited, and above all it disappears rapidly as soon as the volume of the air pump 30 stops varying, i.e. once the reservoir is full. Specifically, the air under pressure in the air pump 30 can escape through the vent hole 36, but at a limited flowrate, guaranteeing a limited momentary increasing pressure and a subsequent rapid relaxation towards atmospheric pressure.

The valve rod S1 is thus applied to the inlet of the filling valve 7 that communicates, directly downstream, with the intermediate chamber I. The axial force F exerted downwards by the user towards the source bottle S makes it possible to move down the valve rod S1, to open the filling valve 7, and to cause the slidable member 3 to move up inside the case 1 towards the fluid pump D. This causes the volume of the reservoir R to increase and the pressure therein to be reduced, thereby causing the fluid from the valve rod S1 to be sucked through the open filling valve 7, the intermediate chamber I, of volume that then increases, and the channels 43 that connect the intermediate chamber I to the reservoir R. The user may press the refillable dispenser on the source bottle S until the reservoir R is full once again, as shown in FIG. 1. When the filling operation has finished, a cover (not shown) may be put into place.

It is possible to optimize the degree of refilling the dispenser by reducing the section of the intermediate chamber I relative to the section of the reservoir R.

In this embodiment, the movable piston 35 slides directly in sealing contact against the outer wall of the dip tube 23, but it is possible to envisage an embodiment in which the movable piston 35 slides against a part that surrounds the dip tube, e.g. that is connected directly to the inlet E of the fluid pump D.

The case 1 masks the slidable member 3 almost completely when the reservoir R is full: However, it is possible to envisage an embodiment in which the case 1 masks the slidable member 3 in part only. Similarly, the case 1 presents a shape that is circularly cylindrical, but any shape, geometrical or otherwise, is possible.

The present invention thus provides a refillable dispenser in which the reservoir is filled very simply by pushing or pressing the refillable dispenser on the valve rod of a source bottle. The reservoir is full once the refillable dispenser can no longer be moved relative to the source bottle. The air pump 30, advantageously a leaky air pump, makes it possible to move the valve rod S1 of the source bottle S immediately, and to avoid the reservoir R being constantly subjected to pressure from the air pump 30.

The invention claimed is:

1. A refillable fluid dispenser comprising: a dispenser head including a fluid pump; a reservoir of variable volume; and a filling valve that is connected to the reservoir;

the fluid pump being provided with a dip tube that passes through the reservoir, a slidable member including a movable piston that slides in sealing contact around the dip tube so as to cause the volume of the reservoir to vary, the slidable member being movable between a pushed-in position in which the slidable member is situated in the proximity of the fluid pump, and an extended position in which the slidable member is spaced apart from the fluid pump, the reservoir defining a maximum volume in its pushed-in position, and a minimum volume in its extended position, such that the volume of the reservoir increases when the slidable member is pushed in around the dip tube towards the fluid pump, the dip tube being provided with a stationary piston that slides in sealing contact in a movable cylinder that is formed by the slidable member, the movable piston sliding around the dip tube between the fluid pump and the stationary piston, the reservoir being defined axially between the movable piston and the stationary piston, and radially between the dip tube and the movable cylinder;

the dispenser further comprises an air pump of variable volume, having a volume that varies inversely with the volume of the reservoir, so as to create resistance to the variation in volume of the reservoir.

2. A dispenser according to claim 1, wherein the air pump is not sealed, thereby communicating with the outside, such that the air in the air pump is put under pressure momentarily during a variation in volume, and then returns to atmospheric pressure a short time after the end of the variation in volume.

3. A dispenser according to claim 1, wherein the air pump includes a vent hole via which air enters and leaves the air pump, thereby enabling the air to return to atmospheric pressure after each variation in volume.

4. A dispenser according to claim 1, wherein the air pump is defined axially between the stationary piston and the filling valve, and is arranged axially below the reservoir.

5. A dispenser according to claim 1, wherein a stationary sleeve is engaged around the dip tube, the stationary sleeve defining a free bottom end that forms a sealing lip that is engaged to slide in sealed manner in a movable tube that is secured to the slidable member, the air pump being defined radially between firstly the stationary sleeve and the movable tube and secondly the movable cylinder.

6. A dispenser according to claim 1, wherein the movable cylinder includes a vent hole.

7. A dispenser according to claim 1, wherein the dip tube is permanently secured to the pump, and the filling valve is permanently secured to the slidable member.

8. A dispenser according to claim 1, wherein the filling valve communicates with the reservoir through an intermediate chamber of volume that varies inversely with the volume of the reservoir, the intermediate chamber communicating with the reservoir through at least one stationary channel that is secured to the dip tube.

9. A dispenser according to claim 1, further comprising a case that is secured to the dip tube and in which the slidable member is movable by sliding in sealed manner around the dip tube.

* * * * *